US009694606B2

(12) United States Patent
Ito et al.

(10) Patent No.: US 9,694,606 B2
(45) Date of Patent: Jul. 4, 2017

(54) INK-JET RECORDING APPARATUS

(71) Applicant: Brother Kogyo Kabushiki Kaisha, Nagoya-shi, Aichi-ken (JP)

(72) Inventors: Tsuyoshi Ito, Nagoya (JP); Iwane Sano, Obu (JP); Gakuro Kanazawa, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/083,877

(22) Filed: Mar. 29, 2016

(65) Prior Publication Data

US 2017/0087886 A1 Mar. 30, 2017

(30) Foreign Application Priority Data

Sep. 30, 2015 (JP) ..... 2015-195474

(51) Int. Cl.
*B41J 13/10* (2006.01)
*B41J 11/04* (2006.01)
*B41J 2/01* (2006.01)

(52) U.S. Cl.
CPC *B41J 11/04* (2013.01); *B41J 2/01* (2013.01)

(58) Field of Classification Search
CPC ..... B41J 11/04; B41J 2/01; B41J 11/02; B41J 11/06; B41J 11/00; B41J 11/0045; B41J 11/005
See application file for complete search history.

(56) References Cited

U.S. PATENT DOCUMENTS

| | | | | |
|---|---|---|---|---|
| 5,356,229 | A | 10/1994 | Hickman et al. | |
| 5,393,151 | A | 2/1995 | Martin et al. | |
| 2002/0051668 | A1 | 5/2002 | Kono | |
| 2003/0025777 | A1 * | 2/2003 | Sugiyama | B41J 11/06 347/104 |

FOREIGN PATENT DOCUMENTS

| | | | |
|---|---|---|---|
| JP | H07-256955 | A | 10/1995 |
| JP | 2000198604 | | 7/2000 |
| JP | 3581606 | B2 | 10/2004 |

* cited by examiner

*Primary Examiner* — Stephen Meier
*Assistant Examiner* — Alexander D Shenderov
(74) *Attorney, Agent, or Firm* — Banner & Witcoff, Ltd.

(57) ABSTRACT

An ink-jet recording apparatus includes: a roller; a first supporting member; a recording section; a second supporting member; and a first waved-shape imparting mechanism configured to impart, to the sheet, the waved shape so that both end portions of the sheet in the width direction are oriented downward. An upstream end portion, of the second supporting surface, in the conveyance direction is located below a downstream end portion of a first supporting surface of the first supporting member in the conveyance direction. The second supporting surface of the second supporting member is formed with projections arranged respectively at locations, of the second supporting surface, at which the both end portions of the sheet in the width direction are supported, the projections projecting upward above a location of the second supporting surface at which a central portion of the sheet in the width direction is supported.

10 Claims, 7 Drawing Sheets

INK-JET RECORDING APPARATUS

CROSS REFERENCE TO RELATED APPLICATION

The present application claims priority from Japanese Patent Application No. 2015-195474 filed on Sep. 30, 2015 the disclosure of which is incorporated herein by reference in its entirety.

BACKGROUND

Field of the Invention

The present invention relates to an ink-jet recording apparatus configured to record an image, etc. on a sheet by discharging ink droplets of an ink from nozzles provided on a recording unit of the ink-jet recording apparatus.

Description of the Related Art

Conventionally, there is known an ink-jet recording apparatus which jets ink droplets from nozzles onto a sheet so as to record an image, etc. on the sheet. In the ink-jet recording apparatus, there is a publicly known configuration wherein a waved state is imparted to a sheet in order to suppress any floating of the sheet from a platen accompanying with deformation of the sheet due to the ink adhered thereto (phenomenon known as "cockling" of the sheet). For example, there is known a configuration, as that for imparting a waved state to a sheet, wherein a platen is provided with a rib formed on the upper surface of the platen. The rib is provided as a plurality of ribs arranged, with an interval therebetween, in a width direction of the width of the sheet orthogonal to a conveyance direction in which the sheet is conveyed. The sheet supported by the plurality of ribs is curved or bent downwardly at portions thereof located between the ribs. With this, the sheet is imparted with a waved shape (waved form) along the width direction of the sheet.

SUMMARY

In this situation, in a case that the ink adheres to the sheet, end portions of the sheet in the width direction thereof are easily curved and easily floated from the platen as compared with a central portion of the sheet in the width direction. Accordingly, in a case of imparting the waved shape along the width direction to the sheet, it is possible to impart such a waved shape that the end portions of the sheet in the width direction become trough (valley, bottom) portions, respectively, of the waved shape. This widens the distance between the nozzles and the end portions of the sheet in the width direction, which in turn makes it possible to lower such a possibility that the sheet might contact the nozzles.

However, in the case of imparting, to the sheet, the waved shape wherein the end portions of the sheet in the width direction become the valley portions of the waved shape, the sheet is easily curved or bent along the conveyance direction, in a portion of the sheet in the downstream side in the conveyance direction, at an edge portion thereof in the downstream side in the conveyance direction (hereinafter referred to as a "downstream edge portion" in the conveyance direction) such that the downstream edge portion of the sheet in the conveyance direction is oriented downward. Further, there is such a fear that the downstream edge portion in the conveyance direction of the sheet in this curved or bent state while being oriented downward might be caught by the rib, etc. Furthermore, in a case that the sheet is conveyed in such a state that the downstream edge portion of the sheet in the conveyance direction is still caught by the ribs, etc., there is such a fear that the curving (warping, bending, curling) of the sheet might become great and the sheet might contact the nozzles.

The present teaching has been made in view of the above-described circumstances; an object of the present teaching is to provide an ink-jet recording apparatus capable of suppressing the curving of a sheet supported by the platen.

According to an aspect of the present teaching, there is provided an ink-jet recording apparatus configured to jet ink onto a sheet, including:

a roller configured to convey the sheet in a conveyance direction;

a first supporting member arranged upstream of the roller in the conveyance direction and having a first supporting surface configured to support the sheet;

a recording section arranged at a position above the first supporting member and configured to jet droplets of the ink toward the first supporting member;

a second supporting member arranged downstream of the first supporting member in the conveyance direction and having a second supporting surface configured to support the sheet between the first supporting member and the roller in the conveyance direction; and a first waved-shape imparting mechanism arranged upstream of the second supporting surface in the conveyance direction and configured to impart, to the sheet, a waved shape along a width direction, of the sheet, which is orthogonal to the conveyance direction, so that both end portions, of the sheet, in the width direction are oriented downward, wherein an upstream end portion, of the second supporting surface, in the conveyance direction is located at a position below a downstream end portion of the first supporting surface in the conveyance direction; and the second supporting surface of the second supporting member is formed with projections arranged respectively at locations, of the second supporting surface, at which the both end portions of the sheet in the width direction are supported by the second supporting surface, the projections projecting upward above a location of the second supporting surface at which a central portion of the sheet in the width direction is supported by the second supporting sheet.

According to this configuration, the first waved-shape imparting mechanism imparts such a waved shape that the both end portions of the sheet in the width direction become the valley portions of the waved shape (or "are oriented downward"). Accordingly, it is possible to suppress any upward floating of both end portions of the sheet in the width direction, and to lower the possibility that the sheet might contact the recording section.

Further, according to the present teaching, the upstream end portion of the second supporting surface in the conveyance direction is located at the position below the downstream edge portion of the first supporting surface in the conveyance direction. Accordingly, the downstream edge portion of the sheet in the conveyance direction can be located at the position below the first supporting surface in the state that the downstream edge portion of the sheet is supported by the upstream end portion of the second supporting surface in the conveyance direction. As a result, it is possible to suppress the floating, from the first supporting surface, of other portion of the sheet which is different from the downstream edge portion of the sheet in the conveyance direction.

Furthermore, the upstream end portion of the second supporting surface in the conveyance direction is located at the position below the downstream edge portion of the first supporting surface in the conveyance direction. Therefore, when any curving of the sheet along the conveyance direction of the sheet occurs in a case that the first waved-shape imparting mechanism imparts to the sheet such a waved shape in which the both end portions of the sheet in the width direction become the valley portions of the waved shape. In other words, when any curving of the sheet along the conveyance direction of the sheet occurs in a case that the first waved-shape imparting mechanism imparts to the sheet such a waved shape in which the both end portions of the sheet in the width direction are oriented downward. Then there is such a fear that the both end portions in the width direction of the sheet, in the downstream edge portion of the sheet in the conveyance direction, might be caught by the second supporting surface.

In view of such a fear, in the present configuration, the second supporting surface is provided with the projections. With this, in the downstream edge portion of the sheet in the conveyance direction, the both end portions in the width direction of the sheet are lifted by the projections. As a result, it is possible to lower such a possibility that in the downstream edge portion of the sheet in the conveyance direction, the both end portions in the width direction of the sheet might be caught by the second supporting surface.

According to the present teaching, it is possible to suppress the curving or warping of the sheet supported by the platen.

DESCRIPTION OF THE EMBODIMENTS

Figure 1:
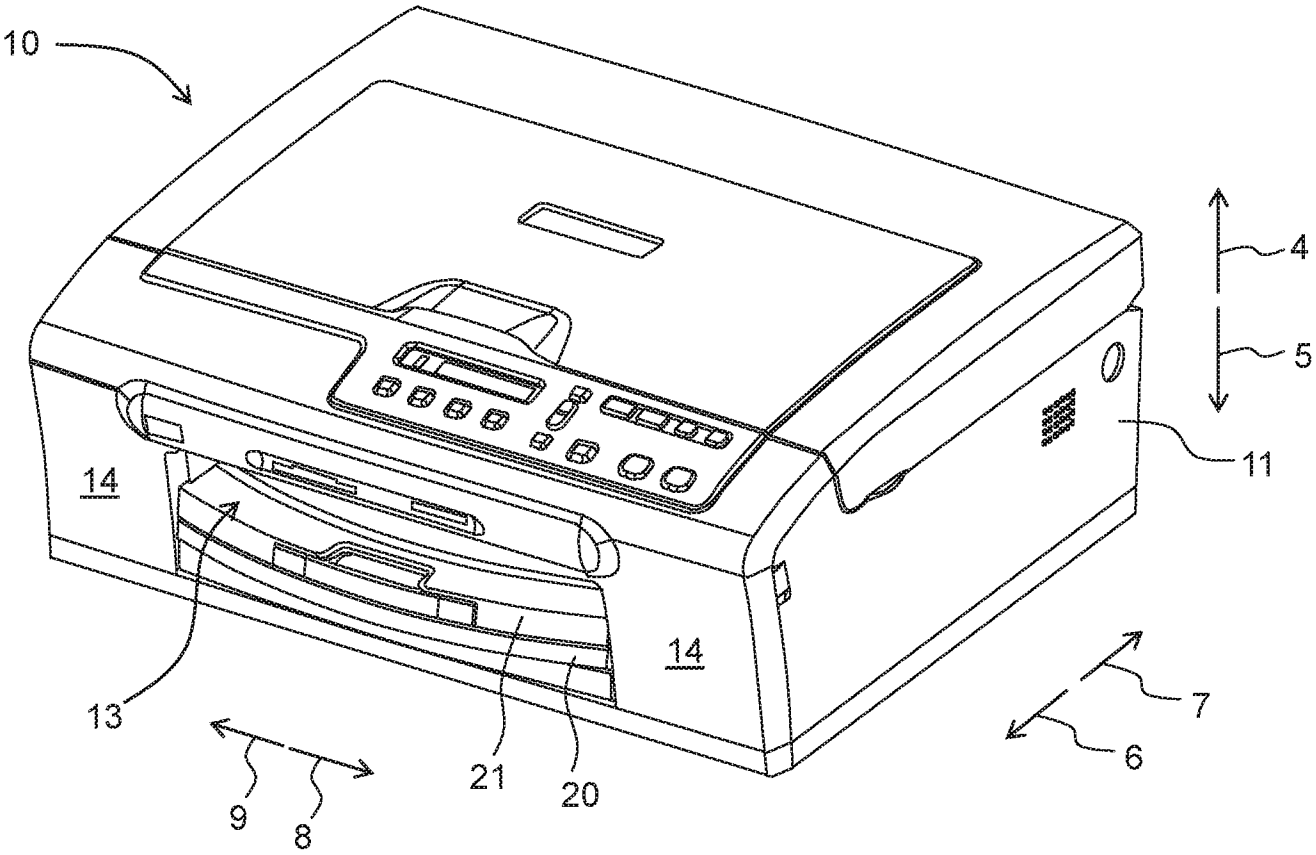
FIG. 1 is a perspective view of a multifunction peripheral 10 as an example of an embodiment of the present teaching.

An embodiment of the present teaching will be described below. Note that, however, the embodiment described below is merely an example of the present teaching; it is possible to make any appropriate change(s) in the embodiment of the present teaching without departing from the gist and/or scope of the present teaching. Note that in the following explanation, a state that a multifunction peripheral 10 is usably installed (a state depicted in FIGS. 1A and 1B) is used as the reference for defining an up direction 4 and a down direction 5. Further, a front direction 6 and a rear direction 7 are defined such that a side on which an opening 13 of the multifunction peripheral 10 is provided is designated as the frontward side (front surface or front side), and a right direction 8 and a left direction 9 are defined as viewing the multifunction peripheral 10 in the rear direction 7. Furthermore, in the embodiment, the up direction 4 and the down direction 5 are mutually opposite directions; the front direction 6 and the rear direction 7 are mutually opposite directions; and the right direction 8 and the left direction 9 are mutually opposite directions. The up direction 4, the front direction 6 and the right direction 8 are orthogonal to one another.

<Entire Structure of Multifunction Peripheral 10>

As depicted in FIG. 1, the multifunction peripheral 10 (an example of an ink-jet recording apparatus) is formed to have a substantially rectangular parallelepiped shape of a thin type. A printer unit 11 is provided in a lower portion of the multifunction peripheral 10. The multifunction peripheral 10 has various functions such as a facsimile function and a print function. As the print function, the multifunction peripheral 10 has a function of recording an image, etc., on one surface of a paper 12 (paper sheet 12; see FIG. 2; an example of a sheet) by an ink-jet system. Note that the multifunction peripheral 10 may be configured to record an image, etc., on both surfaces of the paper 12.

<Feeding Tray 20 and Discharge Tray 21>

Figure 2:
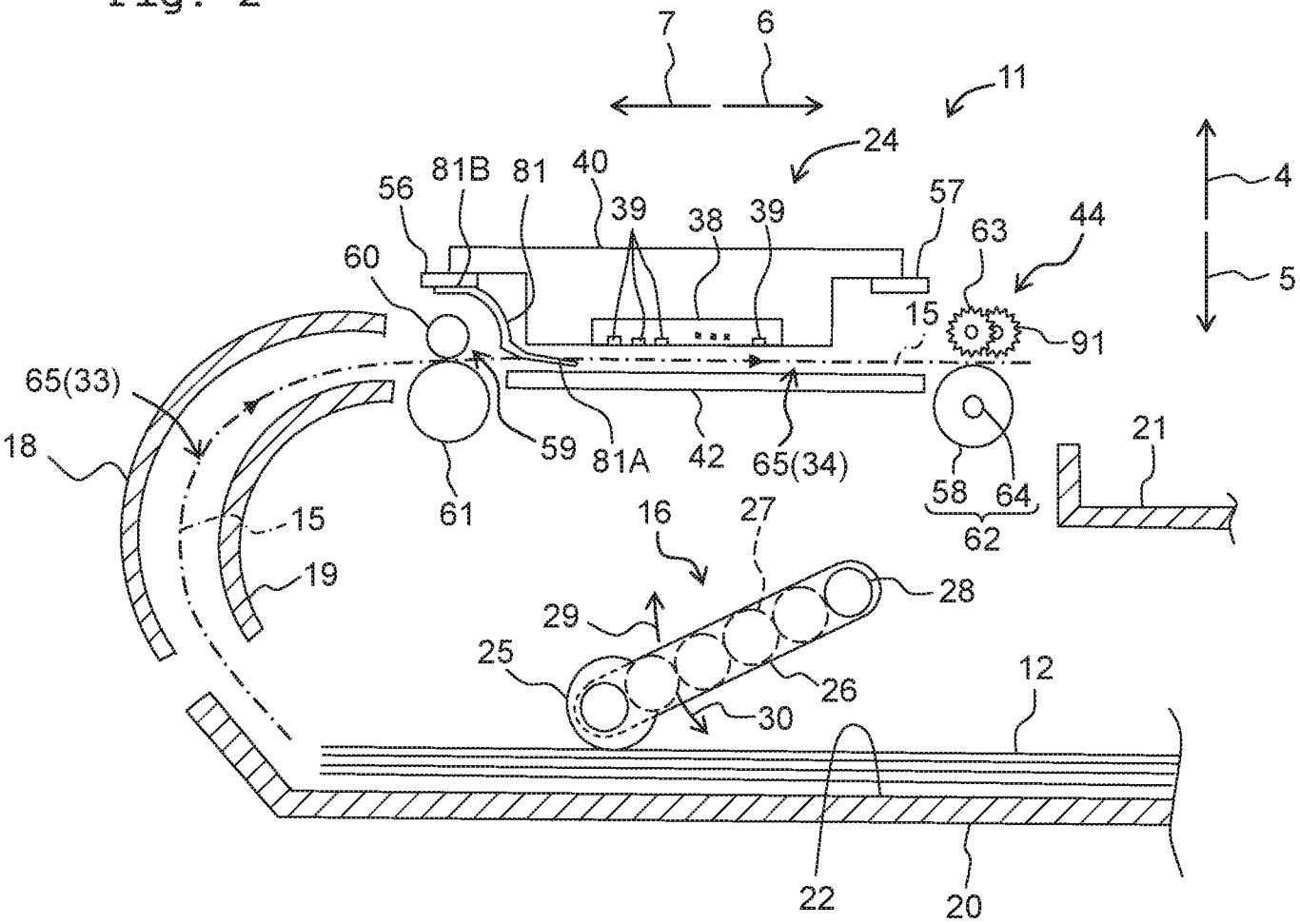
FIG. 2 is a vertical cross-sectional view schematically depicting the internal structure of a printer unit 11.

As depicted in FIG. 1, the printer unit 11 has the opening 13 formed in the front surface of the printer unit 11. In the printer unit 11, a feeding tray 20 is configured to be insertable to and removable or detachable from the printer unit 11 via the opening 13 by being moved in the front direction 6 and in the rear direction 7. The feeding tray 20 is a member having a box-like shape of which upper portion is opened. As depicted in FIG. 2, a plurality of sheets of the paper 12 are supported in a stacked state by a bottom plate 22 of the feeding tray 20. A discharge tray 21 is supported at a position at the upper side of a front portion of the feeding tray 20. The discharge tray 21 is moved in the front direction 6 and the rear direction 7, integrally with the feeding tray 20. A paper 12 having an image recorded thereon by a recording section 24 is discharged on the upper surface of the discharge tray 21.

<Feeding Section 16>

As depicted in FIG. 2, the feeding section 16 is disposed below the recording section 24. The feeding section 16 includes a feeding roller 25, a feeding arm 26, a driving transmitting mechanism 27, and a shaft 28. The feeding roller 25 is rotatably supported by the feeding arm 26 at a front end of the feeding arm 26. The feeding arm 26 rotates or pivots about the shaft 28 disposed on the basal end thereof, in directions indicated by arrows 29 and 30, respectively, with the shaft 28 disposed at the base end of the feeding arm 26 as the rotating center. With this, the feeding roller 25 is capable of contacting with and separating away from the feeding tray 20 or the paper 12 supported by the feeding tray 20.

The feeding roller 25 is rotated by the driving force of a conveyance motor (not depicted in the drawings) which is transmitted from the conveyance motor to the feeding roller 25 by the driving transmitting mechanism 27 constructed of a plurality of gears intermeshed with each other. With this, the feeding roller 25 makes contact with an uppermost paper 12, of the plurality of sheets of the paper 12 supported by the bottom plate 22 of the feeding tray 20, and feeds the uppermost paper 12 to a conveyance route 65. Note that the driving transmitting mechanism 27 is not limited to the aspect constructed of the plurality of gears intermeshed with each other, and may include a belt wound around the shaft 28 and around the shaft of the feeding roller 25.

<Conveyance Route 65>

As depicted in FIG. 2, the conveyance route 65 is extended from a rear-end portion of the feeding tray 20. The conveyance route 65 includes a curved portion 33 and a linear portion 34. The curved portion 33 makes a U-turn from the rear direction 7 toward the front direction 6 while extending toward the up direction 4. The linear portion 34 extends substantially along the front direction 6 and the rear direction 7.

The curved portion 33 is defined by an outer guide member 18 and an inner guide member 19 which are arranged to face with each other with a predetermined interval or gap intervened therebetween. Each of the outer guide member 18 and the inner guide member 19 is provided to extend in the right direction 8 and the left direction 9 which are directions orthogonal to the sheet surface of FIG. 2. The linear portion 34 is defined by the recording section 24 and the platen 42, which face with each other with a predetermined gap intervened therebetween, at a position where the recording section 24 is arranged.

The paper 12 supported by the feeding tray 20 is conveyed in the curved portion 33 by the feeding roller 25, and reaches to a conveyance roller pair 59 (to be described later on). The paper 12 pinched by the conveyance roller pair 59 is conveyed in the linear portion 34 in the front direction 6 toward the recording section 24. The paper 12 arrived at a position immediately below the recording section 24 is subjected to recording of an image thereon by the recording section 24. The paper 12 having the image recorded thereon is conveyed in the linear portion 34 in the front direction 6, and is discharged onto the discharge tray 21. As described above, the paper 12 is conveyed along a conveyance direction 15 as indicated by an arrow of a dashed-dotted line in FIG. 2.

<Recording Section 24>

As depicted in FIG. 2, the recording section 24 is arranged above the linear portion 34. The platen 42 configured to support the paper 12 which is conveyed in the conveyance direction 15 is arranged at a position below the linear portion 34 and facing the recording section 24. The platen 42 will be explained in detail later on.

The recording section 24 is provided with a carriage 40 and a recording head 38. The carriage 40 is supported by two guide rails 56 and 57, which are arranged with an interval therebetween in the front and rear directions 6 and 7, such that the carriage 40 is movable along the right direction 8 and the left direction 9. The guide rail 56 is arranged upstream of the recording head 38 in the conveyance direction 15. The guide rail 57 is arranged downstream of the recording head 38 in the conveyance direction 15. The guide rails 56 and 57 are supported by a pair of side frames (not depicted in the drawings) which are arranged to the outside of the linear portion 34 of the conveyance route 65 in the right direction 8 and the left direction 9. The carriage 40 is moved by a driving force transmitted from a carriage driving motor (not depicted in the drawings) to carriage 40.

The recording head 38 is mounted on the carriage 40. An ink is supplied to the recording head 38 from an ink cartridge (not depicted in the drawings). A plurality of nozzles 39 is formed in the lower surface of the recording head 38. When the carriage 40 is moving in the right direction 8 and in the left direction 9, the recording head 38 discharges or jets ink droplets of the ink from the nozzles 39 toward the platen 42. With this, an image, etc. is recorded on the paper 12 supported by the platen 42.

<Conveyance Roller Pair 59 and Discharge Roller Pair 44>

As depicted in FIG. 2, a conveyance roller pair 59 is arranged in the linear portion 34, at the upstream side of the recording head 38 and the platen 42 in the conveyance direction 15. A discharge roller pair 44 is arranged in the linear portion 34, at the downstream side of the recording head 38 and the platen 42 in the conveyance direction 15.

The conveyance roller pair 59 includes a conveyance roller 60 and a pinch roller 61 located at a position below the conveyance roller 60 and facing the conveyance roller 60. The conveyance roller 60 is a hollow and cylindrically shaped member extending in the right direction 8 and the left direction 9. The conveyance roller 60 is rotatably supported by the pair of side frames (not depicted in the drawings). The pinch roller 61 is provided as a plurality of pinch rollers 61 which are arranged in the right direction 8 and the left direction 9 with an interval therebetween. Each of the pinch rollers 61 is pressed against the conveyance roller 60 by an elastic member such as a coil spring (not depicted in the drawings). The conveyance roller pair 59 is capable of pinching the paper 12 therebetween.

The discharge roller pair 44 includes a discharge roller 62 (an example of a roller) and a spur roller 63 located at a position above the discharge roller 62 and facing the discharge roller 62. The discharge roller 62 is provided with a shaft 64 extending in the right direction 8 and the left direction 9, and roller portions 58 attached to cover the shaft 64, with an interval therebetween in the right direction 8 and the left direction 9. The discharge roller 62 is rotatably supported by the pair of side frames (not depicted in the drawings). The spur roller 63 depicted in FIG. 2 is provided as a plurality of spur rollers 63 which are arranged in the right direction 8 and the left direction 9 with an interval therebetween. Each of the spur rollers 63 is pressed toward the discharge roller 62 by an elastic member such as a coil spring (not depicted in the drawings). Note that in FIGS. 3 to 5 and FIG. 7, the spur rollers 63 are omitted. The discharge roller pair 44 is capable of pinching the paper 12 therebetween.

The conveyance roller 60 and the discharge roller 62 are rotated by receiving a driving force transmitted from the conveyance motor. When the conveyance roller 60 is rotated in a state that the paper 12 is pinched by the conveyance roller pair 59, the paper 12 is conveyed in the conveyance direction 15 by the conveyance roller pair 59, and is conveyed onto the platen 42. On the other hand, when the discharge roller 62 is rotated in a state that the paper 12 is pinched by the discharge roller pair 44, the paper 12 is conveyed in the conveyance direction 15 by the discharge roller pair 44, and is discharged onto the discharge tray 21.

<Abutting Member 81>

As depicted in FIG. 2, an abutting member 81 is arranged upstream of the nozzles 39, formed in the recording head 38, in the conveyance direction 15. The abutting member 81 is formed of a synthetic resin (for example, polyacetal (POM)). Note that the abutting member 81 may be formed of a plurality of members which are combined by, for example, fitting the members, etc.

Figure 3:
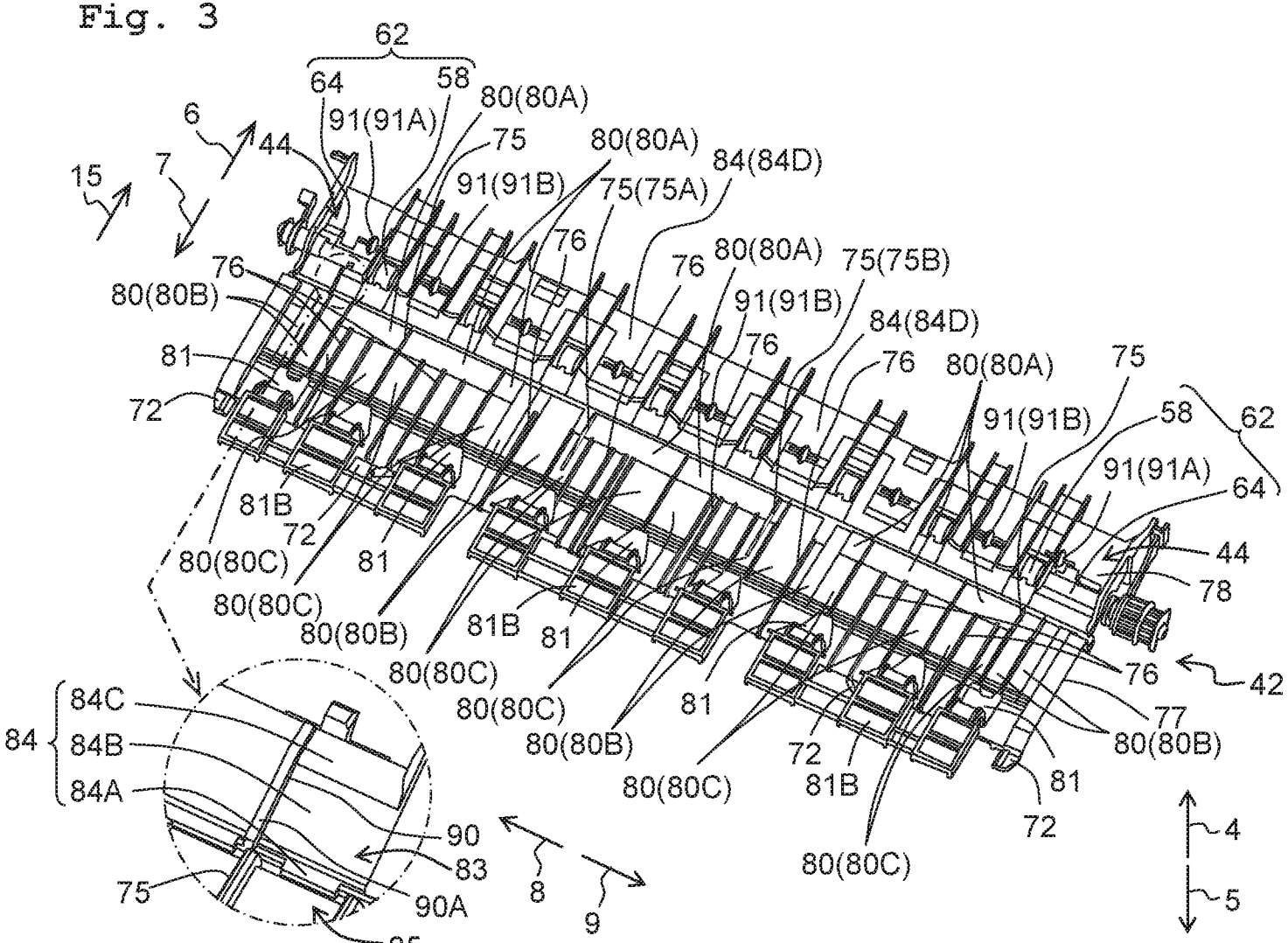
FIG. 3 is a perspective view depicting a platen 42, an abutting member 81 and a discharge roller pair 44.

As depicted in FIG. 3, the abutting member 81 is provided as a plurality of abutting members 81 which are arranged in the right direction 8 and the left direction 9 with an interval therebetween. In the present embodiment, the number of the abutting member 81 is nine. However, the number of the abutting member 81 may be a number other than 9. Further, in the embodiment, three abutting members 81 among the plurality of abutting members 81 are connected. It is allowable, however, that each of the abutting members 81 is independent from each other; alternatively, it is allowable that an appropriate number of pieces of the abutting member 81 are connected to each other.

Each of the abutting members 81 is attached to the guide rail 56 at an upstream end portion 81B thereof in the conveyance direction 15, by a publicly known means such as fitting, etc.

Each of the abutting members 81 is curbed from the upstream end portion 81B downward and frontward. With this, each of the abutting members 81 is extended up to a location in the vicinity of the upstream side of a nozzle 39, which is included in the plurality of nozzles 39 and which is arranged on the most upstream side, in the conveyance direction 15. Further, each of the abutting members 81 is arranged to extend toward the platen 42 in the up direction 4 and the down direction 5. A downstream end portion 81A (an example of a first abutting portion; see FIG. 2) in the conveyance direction 15 of each of the abutting members 81 is capable of abutting against or contacting the upper surface of the paper 12 supported by the platen 42.

<Platen 42>

Figure 4:
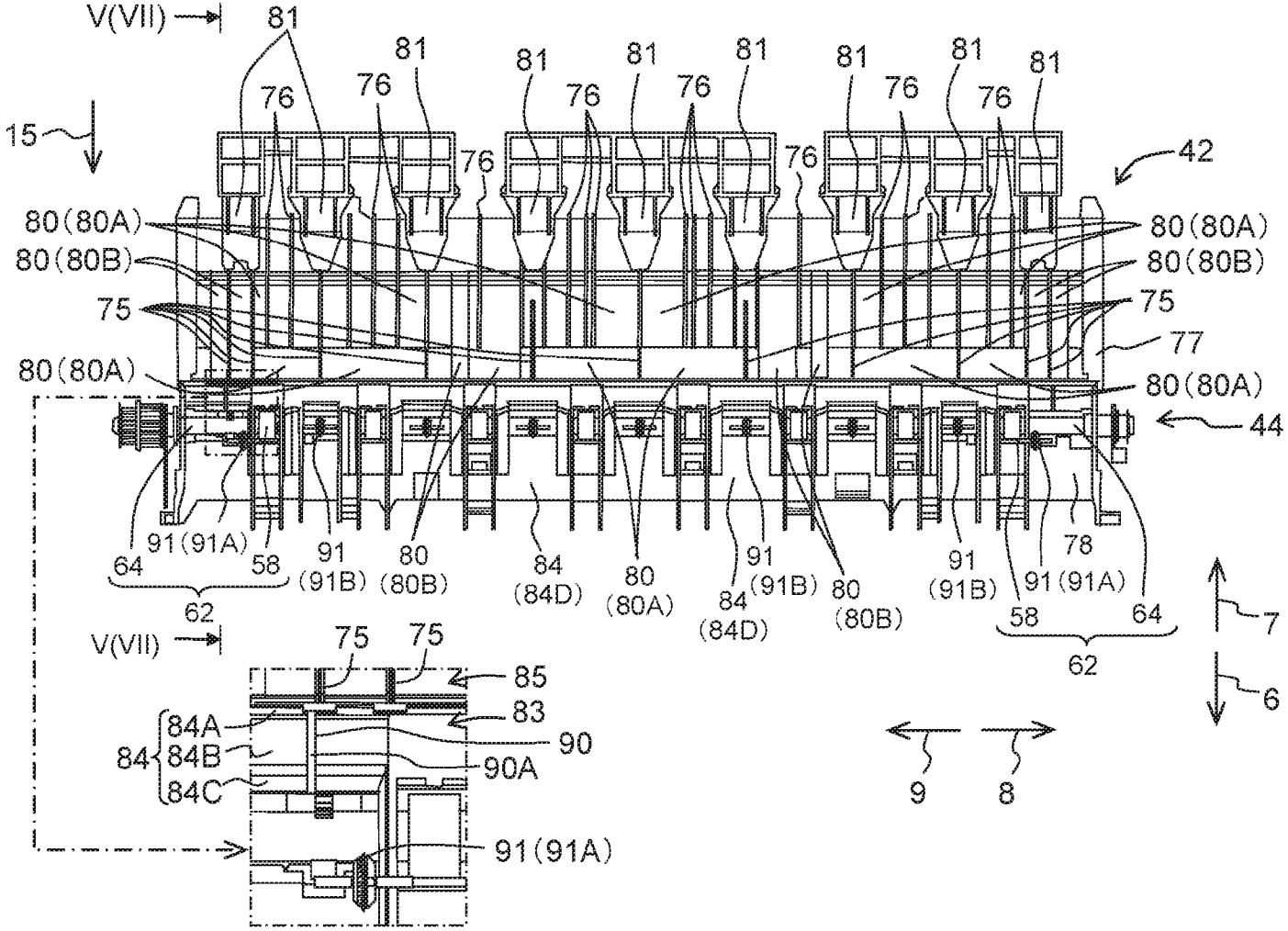
FIG. 4 is a plan view depicting the platen 42, the abutting member 81 and the discharge roller pair 44.
Figure 5:
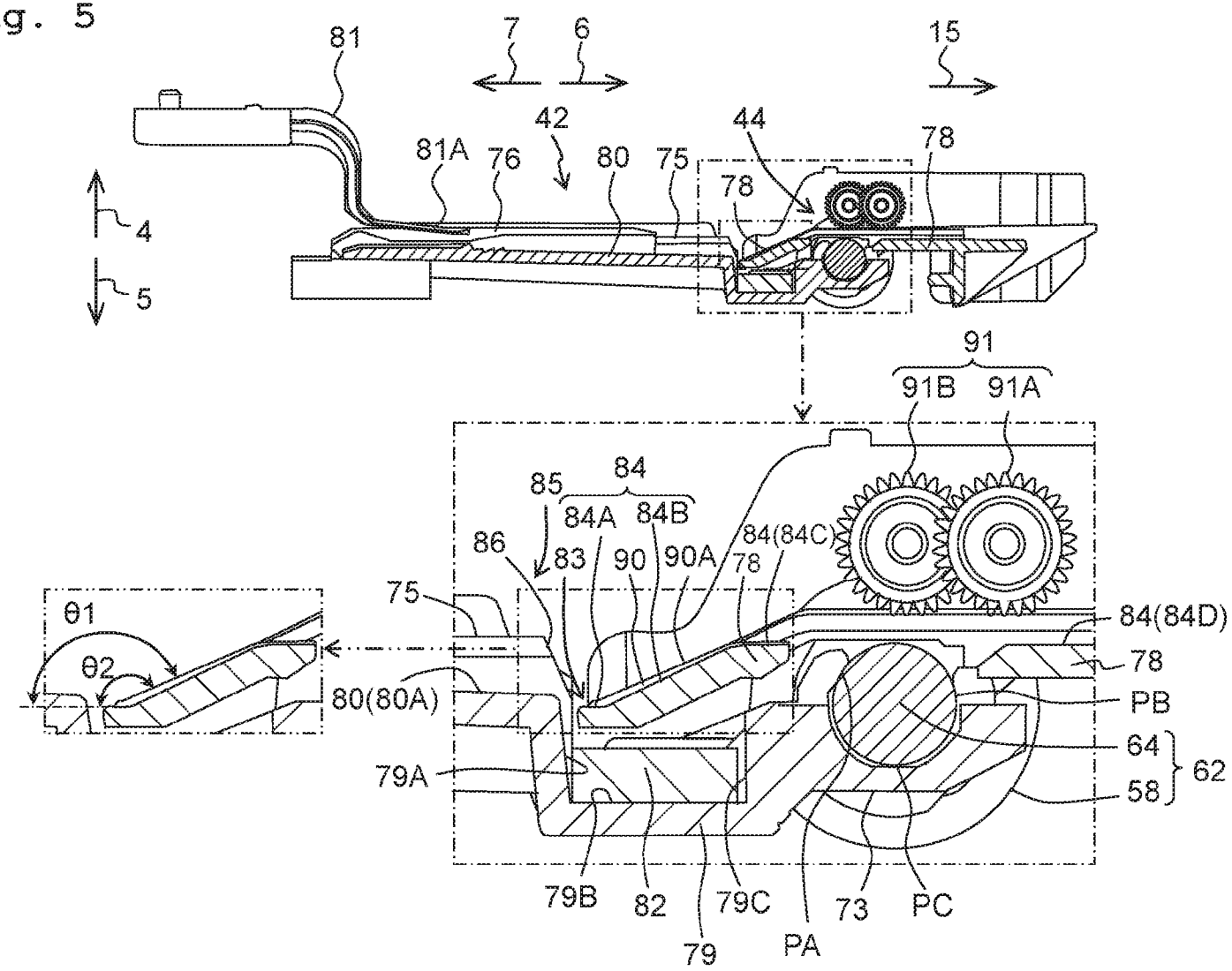
FIG. 5 is a cross-sectional view taken along a line V-V in FIG. 4.

The platen 42 is provided with an upstream supporting portion 77 (an example of a first supporting member), a downstream supporting portion 78 (an example of a second supporting member), and an accommodating portion 79, as depicted in FIGS. 3 to 5.

<Upstream Supporting Portion 77>

The upstream supporting portion 77 is arranged upstream of the downstream supporting portion 78 in the conveyance direction 15.

As depicted in FIG. 3, the upstream supporting portion 77 is a plate-shaped member of which length in the right direction 8 and left direction 9 and length in the front direction 6 and rear direction 7 are longer than the length in the up direction 4 and the down direction 5. The length of the upstream supporting portion 77 in the right direction 8 and left direction 9 is longer than the length of the upstream supporting portion 77 in the front direction 6 and rear direction 7. The upstream supporting portion 77 is arranged to face the nozzles 39 formed in the recording head 38.

As depicted in FIG. 5, the upstream supporting portion 77 is provided with a projection 73 extending in the conveyance direction 15 and arranged at a downstream end portion of the upstream supporting portion 77 in the conveyance direction 15. The projection 73 is provided as a plurality of projections 73 arranged with an interval therebetween in the right direction 8 and the left direction 9. Under a condition that the projections 73 are seen in the right direction 8 and the left direction 9, each of the projections 73 abuts against the shaft 64 of the discharge roller 62 at three positions which are a position PA obliquely upward and upstream of the shaft 64 in the conveyance direction 15, a position PB downstream of the shaft 64 in the conveyance direction 15, and a position PC below the shaft 64. With this, the upstream supporting portion 77 is positioned by the shaft 64 of the discharge roller 62 at the downstream edge portion of the upstream supporting portion 77 in the conveyance direction 15. Here, as described above, the discharge roller 62 is rotatably supported by the pair of side frames, namely by the frame of the multifunction peripheral 10. Namely, the upstream supporting portion 77 is positioned, at the downstream edge portion thereof in the conveyance direction 15, by the frame of the multifunction peripheral 10 via the shaft 64 of the discharge roller 62.

As depicted in FIG. 3, the upstream supporting portion 77 is provided with a projection 72 projecting in an opposite direction to the conveyance direction 15 and arranged at an upstream end portion of the upstream supporting portion 77 in the conveyance direction 15. The projection 72 is provided as a plurality of projections 72 arranged with an interval therebetween in the right direction 8 and the left direction 9. An end portion of a coil spring (not depicted in the drawings) abuts against the lower surface of each of the projections 72. The other end of the coil spring is connected to the frame (not depicted in the drawings) of the multifunction periphery 10. On the other hand, projections (not depicted in the drawings) projecting from the frame of the multifunction peripheral 10 are arranged respectively at positions above projections 72 included in the plurality of projections 72 and located at the both end portions in the right direction 8 and the left direction 9. Further, the projections 72 located at the both end portions in the right direction 8 and the left direction 9 are urged by the coil springs respectively to thereby abut against the projections projecting from the frame of the multifunction peripheral 10, from positions below these projections. With this, the upstream supporting portion 77 is positioned, at the upstream end portion thereof in the conveyance direction 15, by the frame of the multifunction peripheral 10.

As depicted in FIGS. 3 and 4, an upper surface 80 of the upstream supporting portion 77 is a surface expanding in the front direction 6 and rear direction 7 and in the right direction 8 and left direction 9. The upper surface 80 is composed of a first area 80A, a second area 80B and a third area 80C. The first area 80A is an area located immediately below a portion in the vicinity of an edge portion of the paper 12 in the conveyance direction 15, in a case that the recording section 24 performs a so-called borderless printing or margin-less printing wherein the recording section 24 discharges the ink droplets up to the edge portions of the paper 12. The second area 80B is an area located immediately below a portion in the vicinity of the right or left end portion, of each of papers 12 having a various kinds of size which are set as printable by the multifunction peripheral 10, in the case that the recording section 24 performs the borderless printing. The third area 80C is an area located at a position which is different from the location immediately below the edge portion of the paper 12 in the conveyance direction 15 and different from the locations immediately below the right and left end portions of the paper 12 in the conveyance direction 15, in the case that the recording section 24 performs a printing. When the borderless printing is performed by the recording section 24, the ink droplets land on and adhere to locations in the first and second areas 80A and 80B at which the paper 12 is not supported by the downstream edge portions 81A of the abutting members 81. The second area 80B is arranged at a position one step lower than the first area 80A and the third area 80C. In other words, the second area 80 is located below the first area 80A and the third area 80C.

The first area 80A is the area located downstream of the third area 80C in the conveyance direction 15. An upstream end portion of the first area 80A in the conveyance direction 15 is located between certain nozzles 39 included in the plurality of nozzles 39 of the recording head 38 and located most upstream in the conveyance direction 15, and other nozzles 39 included in the plurality of nozzles 39 and located most downstream in the conveyance direction 15. A downstream end portion of the first area 80A in the conveyance direction 15 is located at a substantially same location as the other nozzles 39 included in the plurality of nozzles 39 of the recording head 38 and located most downstream in the conveyance direction 15.

An upstream end portion of the second area 80B is located upstream of the plurality of nozzles 39 of the recording head 38 in the conveyance direction 15. A downstream end portion of the second area 80B in the conveyance direction 15 is located at a substantially same position as the other nozzles 39 included in the plurality of nozzles 39 of the recording head 38 and located most downstream in the conveyance direction 15.

An upstream end portion of the third area 80C in the conveyance direction 15 is located upstream of the plurality of nozzles 39 of the recording head 38 in the conveyance direction 15. A downstream end portion of the third area 80C in the conveyance direction 15 is located between the certain nozzles 39 included in the plurality of nozzles 39 of the recording head 38 and located most upstream in the conveyance direction 15, and the other nozzles 39 included in the plurality of nozzles 39 and located most downstream in the conveyance direction 15.

The upper surface 80 is formed with a plurality of upstream ribs 76 (an example of ribs) and a plurality of downstream ribs 75. The plurality of upstream ribs 76 and the plurality of downstream ribs 75 support the paper 12 at upper end surfaces thereof. This lowers any adhesion of the ink, adhered to the first area 80A and the second area 80B of the upper surface 80, to the lower surface of the paper 12. The upstream ribs 76 and the downstream ribs 75 will be explained in detail later on. Note that in this embodiment, the upstream supporting portion 77 is an example of the first supporting member, and the upstream ribs 76 construct a portion of the upstream supporting portion 77. However, in such a case that the upstream supporting section 77 having the plate-shape is not provided and only the upstream ribs 76 are provided, the upstream ribs 76 may be an example of the first supporting portion.

As depicted in FIG. 5, the accommodating portion 79 is extending from a downstream end portion of the upper surface 80 in the conveyance direction 15. The accommodating portion 79 is arranged from a location below the downstream edge portions of the downstream ribs 75 in the conveyance direction 15 up to a location below the downstream supporting portion 78. The accommodating portion 79 is a recessed portion defined by a side surface 79A extending in the down direction 5 from the downstream edge portion of the upper surface 80 in the conveyance direction 15, a bottom surface 79B extending in the conveyance direction 15 from a lower end portion of the side surface 79A, and a side surface 79C extending in the up direction 4 from a downstream end portion of the bottom surface 79B in the conveyance direction 15. The side surfaces 79A and 79C are each a surface expanding in the up direction 4 and down direction 5 and in the right direction 8 and left direction 9. The bottom surface 79B is a surface expanding in the front direction 6 and rear direction 7 and in the right direction 8 and left direction 9.

The accommodating portion 79 is configured to accommodate an ink absorbing member 82 therein. The ink absorbing member 82 is formed of a porous material such as foamed polyurethane. The upper surface 80 of the upstream supporting portion 77 is inclined slightly in the down direction 5 toward the conveyance direction 15. With this, the ink adhered to the upper surface 80 (the first area 80A and the second area 80B) flows in the conveyance direction 15 and then reaches the accommodating portion 79. Then, the ink flows along the side surface 79A of the accommodating portion 79 and is guided to the ink absorbing member 82. The ink enters into pores formed in the ink absorbing member 82 formed of the porous material, and thus is absorbed by the ink absorbing member 82.

<Upstream Ribs 76>

As depicted in FIGS. 3 and 4, the plurality of upstream ribs 76 are formed in the upper surface 80 of the upstream supporting portion 77. The plurality of upstream ribs 76 support the paper 12 at upper end surfaces (an example of a first supporting surface) thereof.

The upstream ribs 76 are extending from the upstream end portion to the downstream edge portion of the third area 80C in the conveyance direction 15. In other words, the upstream ribs 76 are extending along the conveyance direction 15 from a location upstream of the downstream edge portions of the abutting members 81 in the conveyance direction 15 (the downstream edge portions of the downstream edge portions 81A in the conveyance direction 15) up to a location downstream of the abutting members 81.

The upstream ribs 76 are formed as a plurality of upstream ribs 76 arranged with an interval therebetween in the right direction 8 and the left direction 9. The upstream ribs 76 are formed between the downstream edge portions 81A of abutting members 81 which are included in the plurality of abutting members 81A and which are adjacent in the right direction 8 and the left direction 9. The upper end surfaces of the upstream ribs 76 are located at a position above a location at which the downstream edge portions 81A of the abutting members 81 abut against the upper surface of the paper 12.

Figure 6A:
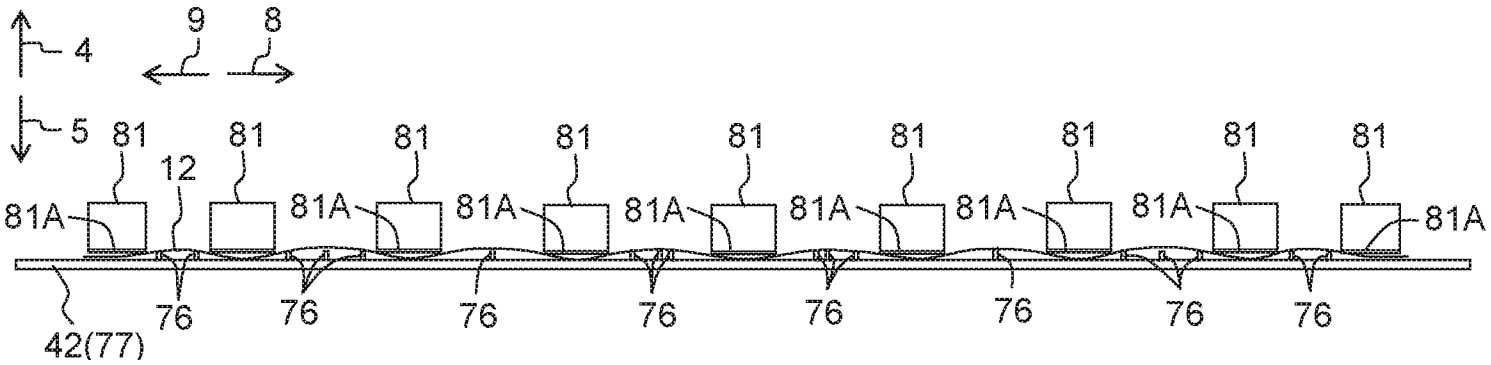
FIG. 6A is a cross-sectional view schematically depicting an upstream supporting portion 77 of the platen 42, the abutting member 81, and a paper 12.

Since the upstream ribs 76 are configured as described above, the paper 12 which is supported by the upper end surfaces of the respective upstream ribs 76 and against which the downstream edge portions 81A of the respective abutting members 81 abut is imparted with a waved shape continued in the right direction 8 and the left direction 9, as depicted in FIG. 6A. Namely, the upstream ribs 76 support the paper 12, thereby imparting the waved shape along the right direction 8 and the left direction 9 to the paper 12 in cooperation with the downstream edge portions 81A of the abutting members 81. As described above, the upstream ribs 76 and the downstream edge portions 81A of the abutting members 81 are an example of a first waved-shape imparting mechanism.

Although the upstream ribs 76 and the abutting members 81 are arranged alternately in the right direction 8 and the left direction 9, those which are located at the rightmost and leftmost positions in this alternate arrangement are the abutting members 81. An abutting member 81, among the abutting members 81, located at the rightmost position abuts against the right end portion of the paper 12 supported by the upstream ribs 76 from a position above the paper 12. An abutting member 81, among the abutting members 81, located at the leftmost position abuts against the left end portion of the paper 12 supported by the upstream ribs 76 from a position above the paper 12. Namely, the abutting members 81 are located at least such positions, respectively, at which the abutting members 81 are capable of abutting against the end portions of the paper 12 in the right direction 8 and left direction 9. Here, in a case that the waved shape is imparted to the paper 12 by the upstream ribs 76 and the downstream edge portions 81A of the abutting members 81, portions in the paper 12 abutting against the upstream ribs 76 become crest (top) portions of the waved shape, and portions in the paper 12 abutting against the downstream edge portions 81A of the abutting members 81 become valley (bottom) portions of the waved shape. Accordingly, the right and left end portions of the paper 12 imparted with the waved shaped by the upstream ribs 76 and the downstream edge portions 81A of the abutting members 81 become the valley portions of the waved shape (see FIG. 6A).

<Downstream Ribs 75>

As depicted in FIGS. 3 and 4, the plurality of downstream ribs 75 are formed in the upper surface 80 of the upstream supporting portion 77. The plurality of downstream ribs 75 are arranged to extend along the conveyance direction 15. The downstream ribs 75 are provided as a plurality of downstream ribs 75 arranged with an interval therebetween in the right direction 8 and the left direction 9. A projecting length by which each of the downstream ribs 75 is projecting in the up direction 4 is shorter than a projecting length by which each of the upstream ribs 76 is projecting in the up direction 4. Namely, the upper end surface of each of the downstream ribs 75 (an example of the first supporting surface) is located at a position below the upper end surface of each of the upstream ribs 76.

Each of the downstream ribs 75 is located between the right end portion and the left end portion of the downstream edge portion 81A of one of the abutting members 81. In other words, the position of each of the downstream ribs 75 in the right direction 8 and the left direction 9 corresponds to the position of the downstream edge portion 81A in the right direction 8 and the left direction 9 of one of the abutting members 81. Further in other words, in the right direction 8 and left direction 9, the positional range occupied by each of the downstream ribs 75 is included in the positional range occupied by the downstream edge portion 81A of one of the abutting members 81. As described above, the downstream ribs 75 are arranged at positions different from positions at which the upstream ribs 76 are arranged, in the right direction 8 and the left direction 9.

Downstream ribs 75 as a portion of the plurality of downstream ribs 75 (downstream ribs 75A and 75B in the embodiment) are extending, along the conveyance direction 15, from a location downstream of the abutting member 81 in the conveyance direction 15 and upstream of the downstream edge portion of the third area 80C in the conveyance direction 15 up to a location downstream of the downstream edge portion of the first area 80A in the conveyance direction 15.

Further, downstream ribs 75 which are included in the plurality of downstream ribs 75 and which are different from the downstream ribs 75A and 75B are extending, along the conveyance direction 15, from the upstream end portion of the first area 80A in the conveyance direction 15 up to a location downstream of the downstream edge portion of the first area 80A in the conveyance direction 15 and of the downstream edge portion of the second area 80B in the conveyance direction 15.

Note that in the embodiment, although the downstream ribs 75 are formed as 11 pieces of the downstream rib 75 as depicted in FIGS. 3 and 4, the number of the downstream ribs 75 is not limited to eleven. For example, only one piece of the downstream rib 75 may be formed on the upper surface 80 of the upstream supporting portion 77 at a central portion thereof in the right direction 8 and the left direction 9.

As depicted in FIG. 5, an inclined surface 86 is formed in a downstream end portion 85 of each of the downstream ribs 75. The inclined surface 86 is inclined downward toward the conveyance direction 15.

Each of the downstream ribs 75 is formed such that the length thereof in the right direction 8 and left direction 9 becomes shorter from the projection basal end thereof toward the projection distal (tip) end thereof, in a range spanning from the upstream to downstream end portions of the downstream rib 75 in the conveyance direction 15. Namely, each of the downstream ribs 75 has a tapered shape tapered upwardly, including a portion thereof formed with the inclined surface 86.

<Downstream Supporting Portion 78>

As depicted in FIGS. 3 and 5, the downstream supporting portion 78 is a plate-shaped member of which length in the right direction 8 and left direction 9 and length in the front direction 6 and rear direction 7 are longer than the length in the up direction 4 and the down direction 5. The length of the downstream supporting portion 78 in the right direction 8 and left direction 9 is longer than the length of the downstream supporting portion 78 in the front direction 6 and rear direction 7. The downstream supporting portion 78 is supported, by the pair of side frames, at the right and left end portions of the downstream supporting portion 78.

The downstream supporting portion 78 is arranged downstream of the upstream supporting portion 77 in the conveyance direction 15. The downstream supporting portion 78 is arranged with a gap (clearance) from the upstream supporting portion 77. Specifically, a gap is defined along the conveyance direction 15 and between an upstream end portion 83 of the downstream supporting portion 78 in the conveyance direction 15 and the downstream edge portion 85 of the upstream supporting portion 77 in the conveyance direction 15.

The upstream end portion 83 of the downstream supporting portion 78 in the conveyance direction 15 is located at a position below the lower end portion of the inclined surface 86 of each of the downstream ribs 75. Further, the upper end portion 83 is located at a position above the accommodating portion 79.

An upper surface 84 of the downstream supporting member 78 is a surface configured to support the paper 12, and is composed of a flat surface 84A (an example of a second supporting surface), an inclined surface 84B (an example of the second supporting surface), a flat surface 84C and a flat surface 84D.

The flat surface 84A is a surface formed on the upstream side of the discharge roller pair 44 in the conveyance direction 15. The flat surface 84A is formed at the upstream end portion 83 of the downstream supporting portion 78. The flat surface 84A is a surface expanding in the front direction 6 and rear direction 7 and in the right direction 8 and left direction 9. The flat surface 84A is located at a position below the lower end surface of the inclined surface 86 of each of the downstream ribs 75.

The inclined surface 84B is a surface formed on the upstream side of the discharge roller pair 44 in the conveyance direction 15. The inclined surface 84B is formed at the downstream side of the flat surface 84A in the conveyance direction 15. In the embodiment, the inclined surface 84B is a surface continued to the downstream edge portion of the flat surface 84A in the conveyance direction 15. Note that it is allowable that the inclined surface 84B is not continued to the downstream edge portion of the flat surface 84A in the conveyance direction 15. The inclined surface 84A is inclined upwardly toward the conveyance direction 15. The inclined surface 84B is a surface expanding in the direction of inclination, and in the right direction 8 and left direction 9.

The flat surface 84C is a surface formed on the upstream side of the discharge roller pair 44 in the conveyance direction 15. The flat surface 84C is formed at the downstream side of the inclined surface 84B in the conveyance direction 15. In the embodiment, the flat surface 84C is a surface continued to the downstream edge portion of the inclined surface 84B in the conveyance direction 15. Note that it is allowable that the flat surface 84C is not continued to the downstream edge portion of the inclined surface 84B in the conveyance direction 15; for example, the flat surface 84C may be formed with a gap defined relative to the inclined surface 84B. The flat surface 84C is a surface expanding in the front direction 6 and rear direction 7 and in the right direction 8 and left direction 9.

The flat surface 84D is a surface formed on the downstream side of the discharge roller pair 44 in the conveyance direction 15, and is configured to support the paper 12 which has passed the discharge roller pair 44. The flat surface 84D is a surface expanding in the front direction 6 and rear direction 7, and in the right direction 8 and left direction 9.

Projections 90 are formed in the flat surface 84A, the inclined surface 84B and the flat surface 84C.

Each of the projections 90 is formed along the conveyance direction 15 and is arranged to extend from the flat surface 84A up to the downstream edge portion of the flat surface 84C in the conveyance direction 15, via the inclined surface 84B. Further, the length of each of the projections 90 in the right direction 8 and the left direction 9 is shorter than the length of the projection 90 along the conveyance direction 15. Namely, each of the projections 90 has a rib shape extending along the conveyance direction 15.

As depicted in FIG. 3, the projections 90 are formed respectively in the right end portions and the left end portions of the flat surface 84A, the inclined surface 84B and the flat surface 84C. The projections 90 abut against the right end portion and the left end portion of the paper 12, respectively, supported by the flat surface 84A, the inclined surface 84B and the flat surface 84C. Namely, the projections 90 are formed at locations in the flat surface 84A, the inclined surface 84B and the flat surface 84C at which the both end portions of the paper 12 in the right direction 8 and left direction 9 are supported.

Each of the projections 90 is projecting in the up direction 4 from the flat surface 84A, the inclined surface 84B and the flat surface 84C. Namely, each of the projections 90 is projecting in the flat surface 84A, the inclined surface 84B and the flat surface 84C in the up direction 4 to be higher than portions of the flat surface 84A, the inclined surface 84B and the flat surface 84C at which the projections 90 are not formed. Namely, the projections 90 are projecting upwardly to be higher than locations in the flat surface 84A, the inclined surface 84B and the flat surface 84C at which the central portion of the paper 12 is supported.

As depicted in FIG. 5, an upper surface 90A of each of the projections 90 is inclined upwardly toward the conveyance direction 15. Here, an angle θ1 defined between the upper surface 90A and a virtual plane including the flat surface 84A is greater than an angle θ2 defined between the inclined surface 84B and the virtual plane.

<Spur Roller 91>

As depicted in FIG. 5, a spur roller 91 (an example of a second abutting portion) is arranged in the linear portion 34 at a location downstream of the discharge roller pair 44 in the conveyance direction 15. A location in the spur roller 91 at which the spur roller 91 abuts against the paper 12, namely the lower end portion of the circumferential surface of the spur roller 91 is located at a position above the upper end portion of the projection 90. With this, the spur roller 91 abuts against the paper 12 from thereabove, at the position above projection 90. Further, the lower end portion of the circumferential surface of the spur roller 91 is located at a position below a holding position at which the paper 12 is pinched by the discharge roller pair 44.

As depicted in FIGS. 3 and 4, the spur roller 91 is provided as a plurality of spur rollers 91 which are arranged with an interval therebetween in the right direction 8 and the left direction 9. In the embodiment, the plurality of spur rollers 91 includes 2 pieces of spur roller 91A and 7 pieces of spur roller 91B. The two spur rollers 91A are arranged respectively at the right side relative to a roller portion 58 which is included in the plurality of roller portions 58 and which is arranged at the rightmost side, and at the left side relative to another roller portion 58 which is included in the plurality of roller portions 58 and which is arranged at the leftmost side. The seven spur rollers 91B are each arranged between two roller portions 58 which are included in the plurality of roller portions 58 and which are adjacent in the right direction 8 and the left direction 9. The spur rollers 91A are arranged downstream of the spur roller 91B in the conveyance direction 15. Further, in the right direction 8 and left direction 9, the positional range occupied by the spur rollers 91 is included in the positional range occupied by the downstream edge portions 81A of the respective abutting members 81.

Since the spur rollers 91 are constructed as described above, the paper 12 which is being conveyed in the linear portion 34 is pressed, at the downstream of the discharge roller pair 44 in the conveyance direction 15, such that the right and left end portions in the upper surface of the paper 12 are pressed by the spur rollers 91A and a predetermined portion in the upper surface of the paper 12 which is different from the right and left end portions is pressed by the spur rollers 91B. Further, the paper 12 is pinched by the discharge roller pair 44 at the location below the spur rollers 91. As a result, the paper 12 is imparted with, by the spur rollers 91 and the discharge roller 62, the waved shape which is along the right direction 8 and the left direction 9 and of which right end portion and left end portions become the valley portions of the waved shape. As described above, the discharge roller 62 and the spur rollers 91 are an example of a second waved-shape imparting mechanism.

According to the embodiment, the upstream ribs 76 and the downstream edge portions 81A of the abutting members 81 impart the waved shape in which the left and right end portions of the paper 12 become the valley portions in the waved shape. Accordingly, it is possible to suppress any upward floating of the left and right end portions of the paper 12 and to lower such a possibility that the paper 12 might contact the recording section 24.

Further, according to the embodiment, the upstream end portion of the downstream supporting portion 78 in the conveyance direction 15, namely the upstream end portions of the flat surface 84A and the inclined surface 84B in the conveyance direction 15 are located at the position below the downstream edge portions 85 of the upstream ribs 76 in the conveyance direction 15. Accordingly, the downstream edge portion of the paper 12 in the conveyance direction 15 can be located at the position below the upper end surfaces of the upstream ribs 76 in the state that the downstream edge portion of the paper 12 in the conveyance direction 15 is supported by the upstream end portions of the flat surface 84A and of the inclined surface 84B in the conveyance direction 15. As a result, it is possible to suppress the floating of other portion, of the paper 12, which is different from the downstream edge portion of the paper 12 in the conveyance direction 15, from the upper end surfaces of the upstream ribs 76.

Furthermore, in the configuration wherein the upstream end portions of the flat surface 84A and the inclined surface 84B in the conveyance direction 15 are located at the position below the downstream edge portions 85 of the upstream ribs 76 in the conveyance direction 15, when any curving of the paper 12 along the conveyance direction 15 of the paper 12 occurs in a case that the upstream ribs 76 and the downstream edge portions 81A of the abutting members 81 impart, to the paper 12, such a waved shape in which the both end portions of the paper 12 in the right and left directions 8 and 9 become the valley portions in the waved shape, then there is such a fear that in the downstream edge portion of the paper 12 in the conveyance direction 15, the both end portions in the right and left directions 8 and 9 of the paper 12 might be caught by the flat surface 84A or the inclined surface 84B.

Figure 6B:
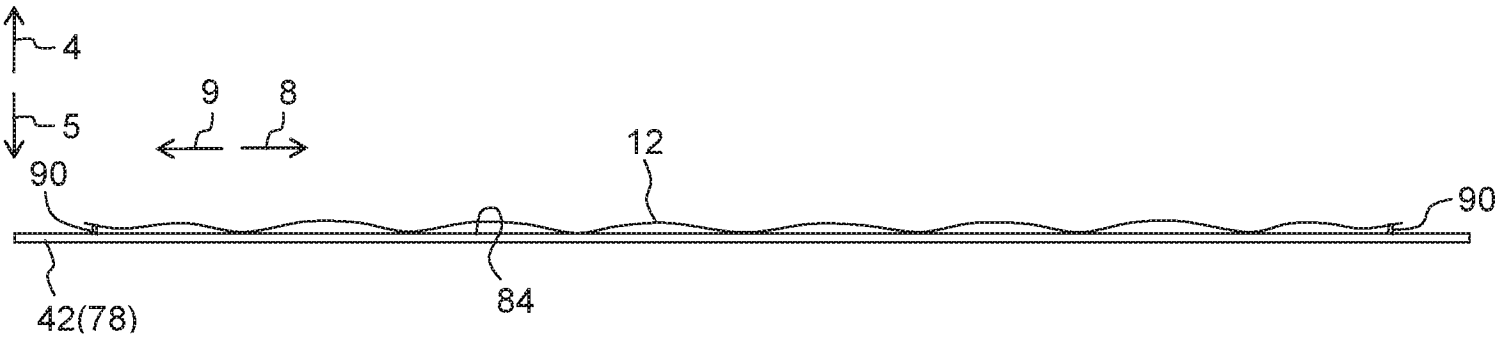
FIG. 6B is a cross-sectional view schematically depicting a downstream supporting portion 78 of the platen 42, and the paper 12.

In view of such a fear, in the present embodiment, the flat surface 84A and the inclined surface 84B are provided with the projections 90. With this, as depicted in FIG. 6B, in the downstream edge portion of the paper 12 in the conveyance direction 15, the both end portions in the right and left directions 8 and 9 of the paper 12 are lifted (raised) by the projections 90. As a result, it is possible to lower such a possibility that in the downstream edge portion of the paper 12 in the conveyance direction 15, the both end portions in the right and left directions 8 and 9 of the paper 12 might be caught by the flat surface 84A or the inclined surface 84B.

Moreover, according to the above-described embodiment, since the projections 90 have the rib shape, even in a case that a mist generated accompanying with the discharge of the ink droplets adheres to the projections 90, it is possible to decrease an amount of the ink mist adhered to the projections 90.

Further, according to the embodiment, the inclined surface 84B is inclined upward toward the conveyance direction 15. Accordingly, the heights of the flat surface 84A and the inclined surface 84B, which are located, in the upstream end portion 83 in the conveyance direction 15 of the downstream supporting portion 78, at the position below the downstream edge portions 85 of the upstream ribs 76 in the conveyance direction 15, can return to a height same as that of the upper end surfaces of the upstream ribs 76, on the downstream side of the upstream end portions 83 of the downstream supporting portions 78 in the conveyance direction 15.

Furthermore, according to the embodiment, the projections 90 are capable of lifting the both end portions of the paper 12 in the right and left directions 8 and 9, at the upstream end portions of the projections 90 in the conveyance direction 15. On the other hand, according to the embodiment, the projection height of each of the projections 90 is shorter in the downstream edge portion of the projection 90 in the conveyance direction 15 than in the upstream end portion of the projection 90 in the conveyance direction 15. Accordingly, the waved shape of the paper 12 along the right and left directions 8 and 9, imparted to the paper 12 by the upstream ribs 76 and the downstream edge portions 81A of the abutting members 81, can be maintained easily on at the portions of the projections 90 on the downstream side in the conveyance direction 15.

Moreover, according to the embodiment, the abutting members 81 are located at least the locations at which the abutting members 81 abut against the both end portions of the paper 12 in the right and left directions 8 and 9. Accordingly, the upstream ribs 76 and the downstream edge portions 81A of the abutting members 81 are capable of imparting, to the paper 12, the waved shape wherein the both end portions of the paper 12 in the right and left directions 8 and 9 become the valley portions, respectively, of the waved shape.

Further, according to the embodiment, the downstream supporting portion 78 is positioned by the shaft 64 of the discharge roller 62. Accordingly, any positional error of the downstream supporting portion 78 relative to the discharge roller 62 can be made small. Accordingly, it is possible to guide the paper 12 supported by the downstream supporting portion 78 to the discharge roller 62 in an ensured manner.

Furthermore, according to the embodiment, the spur rollers 91 make it possible to impart, to the paper 12, the waved shape along the right and left directions 8 and 9 at the downstream side of the discharge roller 62 in the conveyance direction 15.

Moreover, the spur rollers 91 abut against the paper 12 from thereabove at the position above the projections 90. Accordingly, the spur rollers 91 are capable of imparting, to the paper 12, the waved shape along the right and left directions 8 and 9 even though the projections 90 are supporting the both end portions of the paper 12 in the right and left directions 8 and 9.

Further, the spur rollers 91 impart, to the paper 12, the waved shape wherein the both end portions of the paper 12 in the right and left directions 8 and 9 become the valley portions in the waved shape. Accordingly, also on the downstream side of the discharge roller 62 in the conveyance direction 15, it is possible to suppress the upward floating of the both end portions of the paper 12 in right and left directions 8 and 9.

Modified Embodiment

In the above-described embodiment, the projections 90 have the rib shape. It is allowable, however, that the projections 90 do not have the rib shape. For example, it is allowable that the length of the projections 90 in the right and left directions 8 and 9 are not less than the length of the projections 90 along the conveyance direction 15.

Further, the configuration of the projections 90 is not limited to the configuration as depicted in FIG. 5.

Figure 7A:
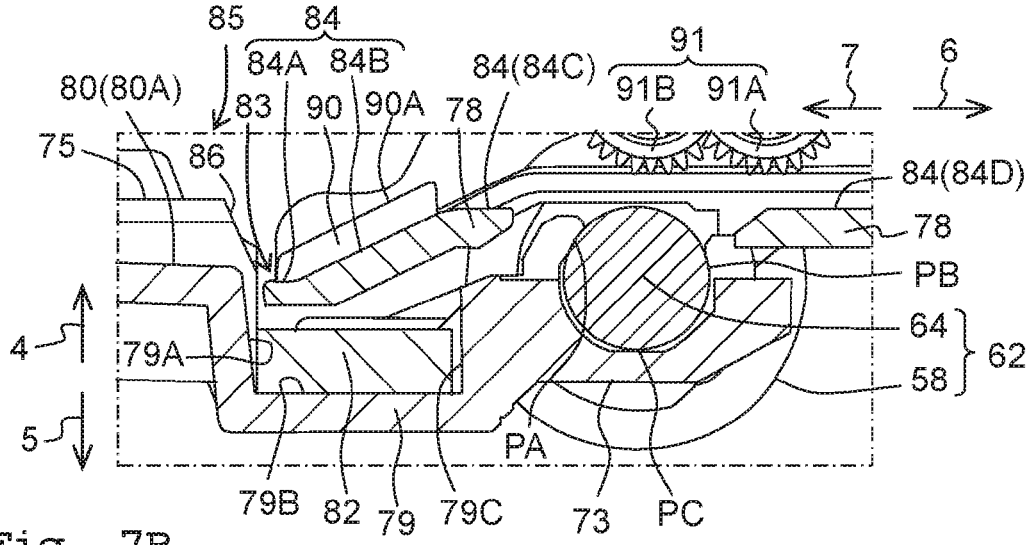
FIGS. 7A to 7C are each a cross-sectional view in a modification, corresponding to the cross-sectional view taken along a line VII-VII in FIG. 4, and depicting the vicinity of a projection 90.
Figure 7B:
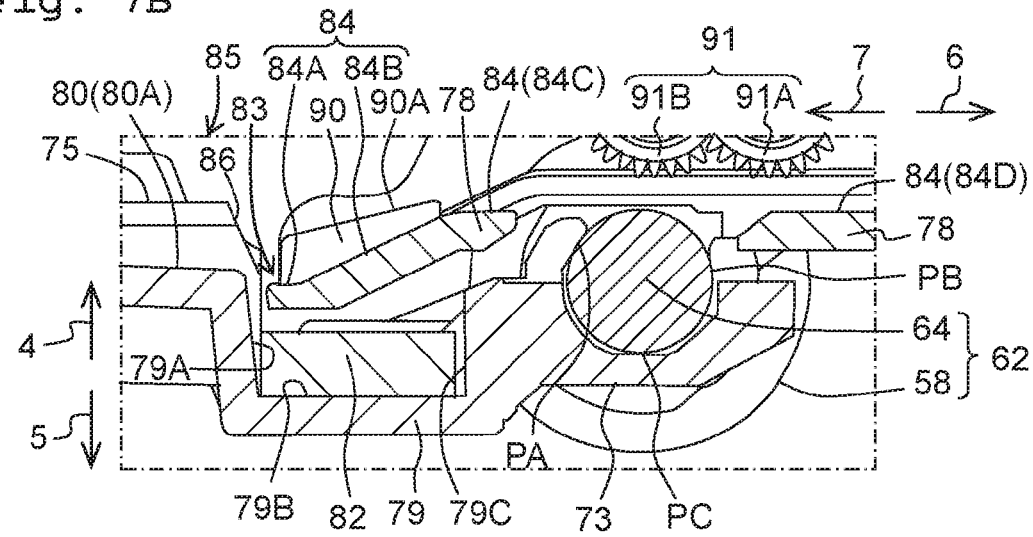
Figure 7C:
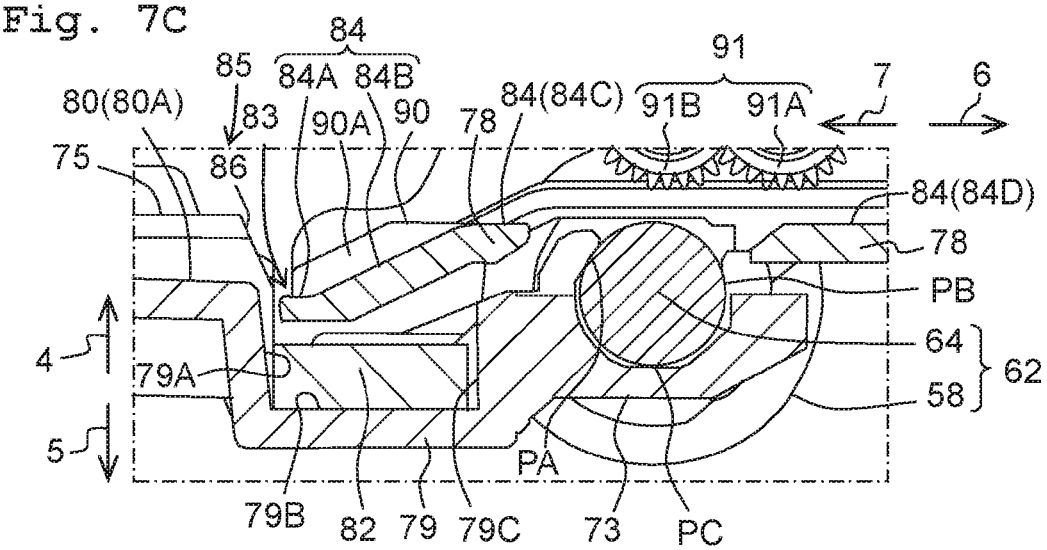

For example, it is allowable that the projections 90 are provided only on the flat surface 84A and the inclined surface 84B, and not provided on the flat surface 84C, as depicted in FIGS. 7A to 7C.

Further, in the embodiment, the upper surface 90A is inclined upward toward the conveyance direction 15; and the angle θ1 is greater than the angle θ2 as depicted in FIG. 5. However, it is allowable that the upper surface 90A is parallel to the inclined surface 84B, as depicted in FIG. 7A. Namely, the angle defined between the upper surface 90A and the flat surface 84A may be equal to the angle defined between the inclined surface 84B and the flat surface 84A.

Furthermore, in the embodiment, each of the projections 90 is projecting such that a portion thereof projecting from the flat surface 84C is projecting highest among the projection 90. However, it is allowable that the projection 90 is projecting such that a portion thereof projecting from the inclined surface 84B is highest among the projection 90, as depicted in FIG. 7B.

Moreover, it is allowable that the projection 90 is configured not to project to a position higher than the flat surface 84C, as depicted in FIG. 7C.

Further, in the embodiment, the discharge roller 62 and the spur rollers 91 impart, to the paper 12, the waved shape at the downstream side of the discharge roller 62 in the conveyance direction 15. However, the portion or element imparting the waved shape is not limited to the discharge roller 62 and the spur rollers 91. For example, it is allowable to adopt a member such as the abutting member 81, instead of adopting the spur roller 91. Alternatively, it is allowable to adopt a rib formed downstream of the discharge roller 62 in the conveyance direction 15, instead of adopting the discharge roller 62. Such a rib is formed, for example, in the flat surface 84D of the upper surface 84 of the downstream supporting portion 78.

In the embodiment, in the right and left directions 8 and 9, the positional range occupied by each of the downstream ribs 75 is included in the positional range occupied by the downstream edge portion 81A of one of the abutting members 81. It is allowable, however, that in the right and left directions 8 and 9, the positional range occupied by each of the downstream ribs 75 is overlapped at least partially with (overlapped with at least a portion of) the positional range occupied by the downstream edge portion 81A of one of the abutting members 81. For example, it is allowable that the right end portion of each of the downstream ribs 75 is located on the right side relative to the right end portion of the downstream edge portion 81A of one of the abutting members 81, and that the left end portion of each of the downstream ribs 75 is located between the right end portion and the left end portion of the downstream edge portion 81A of one of the abutting members 81.

Further, in the embodiment and in the configuration as described in the foregoing paragraphs, the positional range occupied by each of the downstream ribs 75 is overlapped with the positional range occupied by the downstream edge portion 81A of one of the abutting members 81 in the right and left directions 8 and 9. It is allowable, however, that the positional range occupied by each of certain downstream ribs 75 as a portion of the plurality of downstream ribs 75 is overlapped with the positional range occupied by the downstream edge portion 81A of one of the abutting members 81 in the right and left directions 8 and 9, while the positional range occupied by each of downstream ribs 75 as a remaining portion of the plurality of downstream ribs 75 which are different from the certain downstream ribs 75 as the portion of the plurality of downstream ribs 75 is not overlapped with the positional range occupied by the downstream edge portion 81A of one of the abutting members 81 in the right and left directions 8 and 9.

Furthermore, in the embodiment, the upstream ribs 76 and the downstream edge portions 81A of the abutting members 81 cooperate to impart, to the paper 12, the waved shape along the right and left directions 8 and 9. The upstream ribs 76 and the abutting members 81 correspond to the first waved-shape imparting mechanism. However, under a condition that the first waved-shape imparting mechanism is a mechanism configured to impart the waved shape along the right and left directions 8 and 9 to the paper 12, the configuration of the first waved-shape imparting mechanism is not limited to the configuration of the embodiment as described above.

For example, it is allowable that only the upstream ribs 76 impart the waved shape along the right and left directions 8 and 9 to the paper 12. Namely, it is allowable that the abutting members 81 are not provided. In such a case, the paper 12 is supported by the upstream ribs 76, and is sunk at portions of the paper 12 which are each located between adjacent upstream ribs 76 among the upstream ribs 76 and which are sunk due to the weight of the ink landed on the portions of the paper 12, or due to the weight of the paper 12 itself. With this, the waved shape along the right and left directions 8 and 9 is imparted to the paper 12. Namely, in this case, the upstream ribs 76 correspond to the first waved-shape imparting mechanism.

Moreover, in the embodiment, although the upper surface 84 of the downstream supporting portion 78 is composed of the flat surface 84A, the inclined surface 84B and the flat surface 84C, the upper surface 84 of the downstream supporting portion 78 is not limited to this configuration. For example, the upper surface 84A may be composed only of the flat surface 84A, or only of the inclined surface 84B.

Further, in the embodiment, although the downstream ribs 75 have the tapered shape tapered upwardly, it is allowable that the downstream ribs 75 do not have the tapered shape.

What is claimed is:

1. An ink-jet recording apparatus configured to jet ink onto a sheet, comprising:

a roller configured to convey the sheet in a conveyance direction;

a first supporting member arranged upstream of the roller in the conveyance direction and having a first supporting surface configured to support the sheet;

a recording section arranged at a position above the first supporting member and configured to jet droplets of the ink toward the first supporting member;

a second supporting member arranged downstream of the first supporting member in the conveyance direction and having a second supporting surface configured to support the sheet between the first supporting member and the roller in the conveyance direction; and a first waved-shape imparting mechanism arranged upstream of the second supporting surface in the conveyance direction and configured to impart, to the sheet, a waved shape along a width direction, of the sheet, which is orthogonal to the conveyance direction, so that both end portions, of the sheet, in the width direction are oriented downward, wherein an upstream end portion, of the second supporting surface, in the conveyance direction is located at a position below a downstream end portion of the first supporting surface in the conveyance direction; and the second supporting surface of the second supporting member is formed with projections arranged respectively at locations, of the second supporting surface, at which both end portions of the sheet in the width direction are supported by the second supporting surface, the projections projecting upward above a location of the second supporting surface at which a central portion of the sheet in the width direction is supported by the second supporting surface.

2. The ink-jet recording apparatus according to claim 1, wherein the projections have a rib shape extending along the conveyance direction.

3. The ink-jet recording apparatus according to claim 1, wherein the second supporting surface is inclined upward toward the conveyance direction.

4. The ink-jet recording apparatus according to claim 3, wherein an upper surface of each of the projections is inclined upward toward the conveyance direction; and an angle defined between the upper surface of each of the projections and a virtual plane expanding in the conveyance direction and the width direction is greater than an angle defined between the second supporting surface and the virtual plane.

5. The ink-jet recording apparatus according to claim 1, wherein the first waved-shape imparting mechanism is provided with a plurality of ribs which construct a portion of the first supporting member; and the plurality of ribs are formed to extend along the conveyance direction, and are arranged with an interval therebetween in the width direction.

6. The ink-jet recording apparatus according to claim 5, wherein upper end surfaces of the plurality of ribs construct the first supporting surface of the first supporting member.

7. The ink-jet recording apparatus according to claim 5, wherein the first waved-shape imparting mechanism is provided with a plurality of abutting portions which are arranged to each interval of the plurality of ribs in the width direction, and which are configured to abut against the sheet from thereabove at a position below upper ends of the plurality of ribs; and outermost abutting portions, of the plurality of abutting portions, in the width direction are arranged so that the outermost abutting portions abut against the end portions of the sheet in the width direction at an area outside of outermost ribs of the plurality of the ribs in the width direction.

8. The ink-jet recording apparatus according to claim 7, wherein the projections are arranged outside of the outermost ribs in the width direction.

9. The ink-jet recording apparatus according to claim 1, wherein the second supporting member is positioned by a shaft of the roller.

10. The ink-jet recording apparatus according to claim 1, further comprising a second waved-shape imparting mechanism configured to impart, to the sheet, the waved shape along the conveyance direction, and having a plurality of abutting portions which are arranged downstream of the roller in the conveyance direction, with an interval therebetween in the width direction and which are configured to abut against the sheet from thereabove at a position above the projections; and the plurality of abutting portions are arranged to abut against the end portions of the sheet in the width direction.

* * * * *